US008215067B2

(12) United States Patent
Segura

(10) Patent No.: US 8,215,067 B2
(45) Date of Patent: Jul. 10, 2012

(54) VASE WITH PHOTOGRAPHS, INSCRIPTIONS AND DEPOSIT OF FLOWERS FOR CEMETERY MEMORIALS

(75) Inventor: Armando F. Segura, Miami, FL (US)

(73) Assignee: Armando F. Segura, Miami, FL (US)

( * ) Notice: Subject to any disclaimer, the term of this patent is extended or adjusted under 35 U.S.C. 154(b) by 348 days.

(21) Appl. No.: 11/504,202

(22) Filed: Aug. 15, 2006

(65) Prior Publication Data

US 2008/0028692 A1 Feb. 7, 2008

(51) Int. Cl.
*E01F 9/011* (2006.01)
*E04H 13/00* (2006.01)

(52) U.S. Cl. ..... 52/103; 47/41.01

(58) Field of Classification Search ..... 52/103; 40/124.5; 47/41.01, 41.1
See application file for complete search history.

(56) References Cited

U.S. PATENT DOCUMENTS

| | | | | | |
|---|---|---|---|---|---|
| 1,784,621 | A * | 12/1930 | Boyer | 47/41.1 |
| 1,958,790 | A * | 5/1934 | Jippson | 47/41.1 |
| 2,810,990 | A * | 10/1957 | Wright | 47/41.1 |
| 3,001,326 | A * | 9/1961 | O'Brien et al. | 47/41.1 |
| 3,302,326 | A * | 2/1967 | Maino | 47/41.1 |
| 4,801,014 | A * | 1/1989 | Meadows | 206/423 |
| 5,870,856 | A * | 2/1999 | Friend | 47/65.7 |
| 6,170,193 | B1 * | 1/2001 | Wright et al. | 47/41.1 |
| 2002/0007601 | A1 * | 1/2002 | England | 52/103 |
| 2005/0126058 | A1 * | 6/2005 | Rojdev et al. | 40/124.5 |

* cited by examiner

*Primary Examiner* — Brian Glessner
*Assistant Examiner* — Adriana Figueroa

(57) ABSTRACT

The present invention relates to a flower vase for a cemetery memorial that can be stored within a compartment on the memorial when it is not in use. The cylindrical and hollow flower identification vase includes two photographs, two bronze engraving tags with personal data of the deceased people, a container for water and flowers when in an upright position, a serial number and exactly identification of the place where the vase is located in the cemetery property and a connection system between the vase and the compartment.

3 Claims, 6 Drawing Sheets

VASE WITH PHOTOGRAPHS, INSCRIPTIONS AND DEPOSIT OF FLOWERS FOR CEMETERY MEMORIALS

BACKGROUND OF THE INVENTION

1. Field of the Invention

The present invention relates to cemetery memorials. More specifically this invention relates to a flower vase for cemetery memorial which can be stored within a compartment on the memorial when it is not in use. This invention essentially relates to a cylindrical and hollow identification flower vase for cemetery memorials that includes two photographs in very lasting material for outside exhibition, two bronze engraving tags with personal data of the deceased people, a container for water and flowers, serial number and exactly identification of the place where are located the vase in the cemetery property, all of them in the same body of the vase. Other object of this invention is to provide a mechanical means system of connection between the base of said vase with the ring base of said compartment and also means for guiding the placement and withdrawn of said vase in the storage compartment by two vertical columns in both sides of said vase so as to minimize abrasion or damages in its body.

2. Prior Art

The use of cemetery grave markers, tombstones and the like ("cemetery memorials") to adorn and mark gravesites is wellknown. These cemetery memorials can include elaborate crypts, sculptures and other similar adornments. More recently, these cemetery memorials have become substantial more subtle and tasteful, often comprising a simple slab of marble having an inscription, placed horizontally on a grave site. Typically, such memorials also have one or more compartments for placement of memorabilia and/or flowers. U.S. Pub. No. 2005/0126058 (Pub. Date Jun. 16, 2005, by Rojdev et al) is representative of this more contemporary style of monument—which is herein incorporated by reference in its entirety. In brief, the Rojdev memorial concept comprises an essentially hollow, rectangular marble base, which is place on the grave site, in the horizontal position. This Rojdev memorial includes a number of compartments accessible from the face surface of the marble slab. These compartments can be used to store memorabilia of the deceased, or offerings by his survivors, and/or flowers. The integration of these compartments, within the face surface of the marble slab of a cemetery memorial, has the reported advantage of minimizing clutter on the grave site, and the elimination of theft of, for example, vases and urns that are often used to adorn the memorial on the grave site. Additional examples of this integration of a receptacle/compartment within a grave stone are shown in U.S. Pat. No. 4,722,160 (to Davis—issued Feb. 2, 1998); U.S. Pat. No. 6,088,955 (to Nelson et al—issued Jul. 18, 2000); and Pub. No. 2002/0007601 (to Kachigian—Pub. Date Jan. 24, 2002)—which are herein incorporated by reference in their entirety.

The problem of vandalism and theft particularly of items associated with a grave markers, such as items which can be readily displaced or removed, cannot be underestimated. For example, flower vases are a particular favorite of vandals and thieves because they are easy to remove from the grave sites and, are virtually untraceable. Thus, these simple items can be resold and reused without detection or consequence. Accordingly, there continues to exist a need to provide a multiple identification vase for cemetery memorials which includes one or more integrated compartments, particularly compartments, that can both serve as a flower holders or vases for flower offering, that can be stored within the memorial when it is not in use. Such integration should also include means of several information associated with the holder or vase which discourages theft and is yet tasteful and respectful of the memorial.

OBJECTS OF THE INVENTION

It is the object of this invention to remedy the above as well as related deficiencies in the prior art.

More specifically, it is the principle of object of this invention to provide an assembly comprise an assembly, in the form of an accessible compartment, and a cemetery identification vase within such compartment that can be integrated with a cemetery memorial.

It is another object of this invention to provide an assembly, which includes an identification flower vase, which is both structurally and cosmetically compatible with a cemetery memorial, and which both facilitates the mounting of such vase on the memorial; and, thereafter, the storage thereof within the memorial, when no longer in use.

It is still yet another object of the invention to provide an assembly for housing a flower vase, wherein the vase include permanent and distinctive indicia, in the form of a picture, serial number, personal identification tags and a grave site address to permit its ready identification, and thereby discourage the theft of the vase from the memorial.

It is a further object of this invention to provide an assembly for housing a flower identification vase, wherein such assembly includes a storage compartment having an open end and closed end, and means for engagement of the open end of such storage compartment with the base of the vase.

Additional objects of this invention include means for discouraging the theft of a flower identification vase from a cemetery memorial.

SUMMARY OF THE INVENTION

The above and related objects are achieved by providing an assembly having an accessible storage compartment for a flower identification vase, and a vase, wherein such assembly can be readily integrated within a cemetery memorial. In the preferred embodiments of this invention, the storage compartment is complimentary in overall dimension to the cylindrical shape of the vase, so as to allow for storage of the vase within the compartment of the assembly, when it is not in use; and, for withdrawal of the vase from the compartment, and mounting thereof on the open end of the storage compartment, so as to accommodate the placement of flowers therein. The overall structure and dimensions of this storage compartment are adapted for placement and mounting within a hole in the marble slab of a cemetery memorial.

In the context of this invention, the vase of this assembly include a plaque containing certain indicia to identify it, as belonging to a specific cemetery memorial or grave site, and include a likeness of the individual interred within the grave site. The likeness can be prepared by applying a photo to a ceramic plate, reproducing the likeness of the individual, by photographic imaging techniques, and, thereafter, sealing the photographic reproduction of the likeness of the interred individual with a clear finish glaze. The photo printed in a ceramic plate can be permanently affixed on the two front recessed part of the body of the vase by adhesives and/or conventional metal working techniques.

BRIEF DESCRIPTION OF DRAWINGS

FIG. 3-A is an enlarged detail of the vase on FIG. 3 that shows, in the base of rest of the vase, two inverse radiating projections (11) configured to interlock with two reverted flanges in semicircle located on the ring base (FIGS. 6, 13) to mounting and fixed the vase in the vertical outside exhibition.

DETAILED DESCRIPTION OF THE INVENTION INCLUDING PREFERRED EMBODIMENTS

Figure 1:
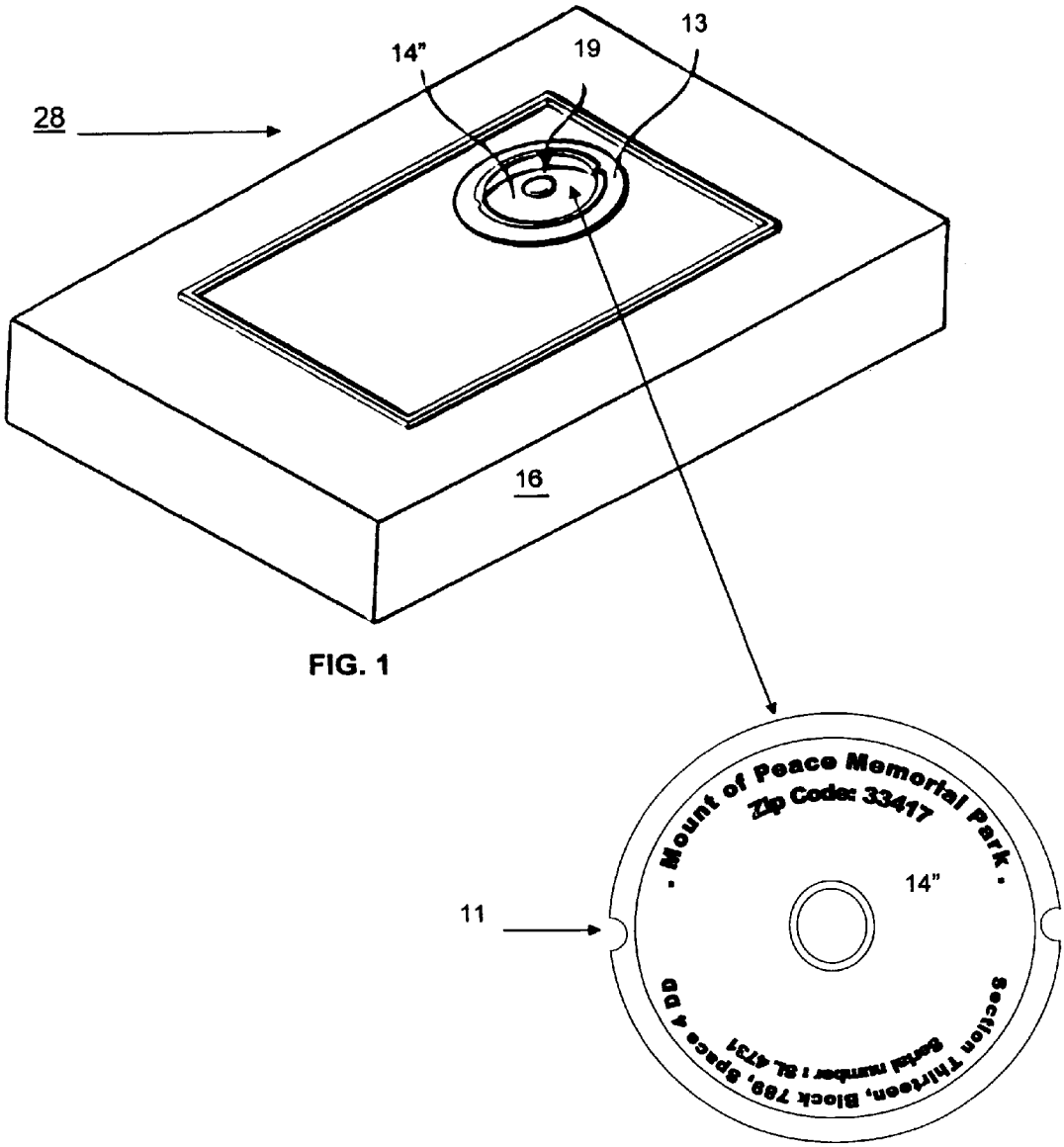
FIG. 1 is a perspective view of a cemetery memorial having integrated storage compartment flush mounted on the face of the memorial and an enlarged perspective view of the bottom of the base of the vase to identify the grave site to which the vase belongs and its serial number.

The basic concept of this invention is directed to a cylindrical and hollow identification cemetery vase (14) with a container for water and flowers (14') that include, in the two recessed spaces in the front of said vase (32, 33), a personal photographs printed in ceramic plaques for very lasting outside exhibition. Said vase also included two engraved tags with the personal information of the deceased person (8, 9) and serial number/grave site information located on the internal part of the bottom of the base (14") of the vase (14), all of them in the same body of said vase(14). This invention is an assembly (10) which can be used in combination with a cemetery memorial (28), specifically, a memorial which is compatible with the inclusion of an accessible compartment for housing a flower vase (14) or other storage related items. FIG. 1 illustrates one of the preferred embodiments of a cemetery memorial (28) of this invention having integrated therein an accessible storage compartment (12) and complimentary flower identification vase (14). As is apparent from FIG. 1, a hole is first cut into the face of the marble slab (16) of the memorial (28), to allow for the insertion of an assembly (10) comprising a vase (14) an and accessible storage compartment (12) for the vase (14). The assembly (10) is affixed to the marble face (16) of the memorial (28) by bonding a flange (13) of the assembly (10) to the marble. In FIG. 1 the flower identification vase (14) is placed in an inverted position within the accessible storage compartment (12), and thus is not visible, except for the bottom of the base (14") portion thereof, which is in sealing engagement with the open end (12') of the storage compartment (12) of the assembly (10).

Figure 2:
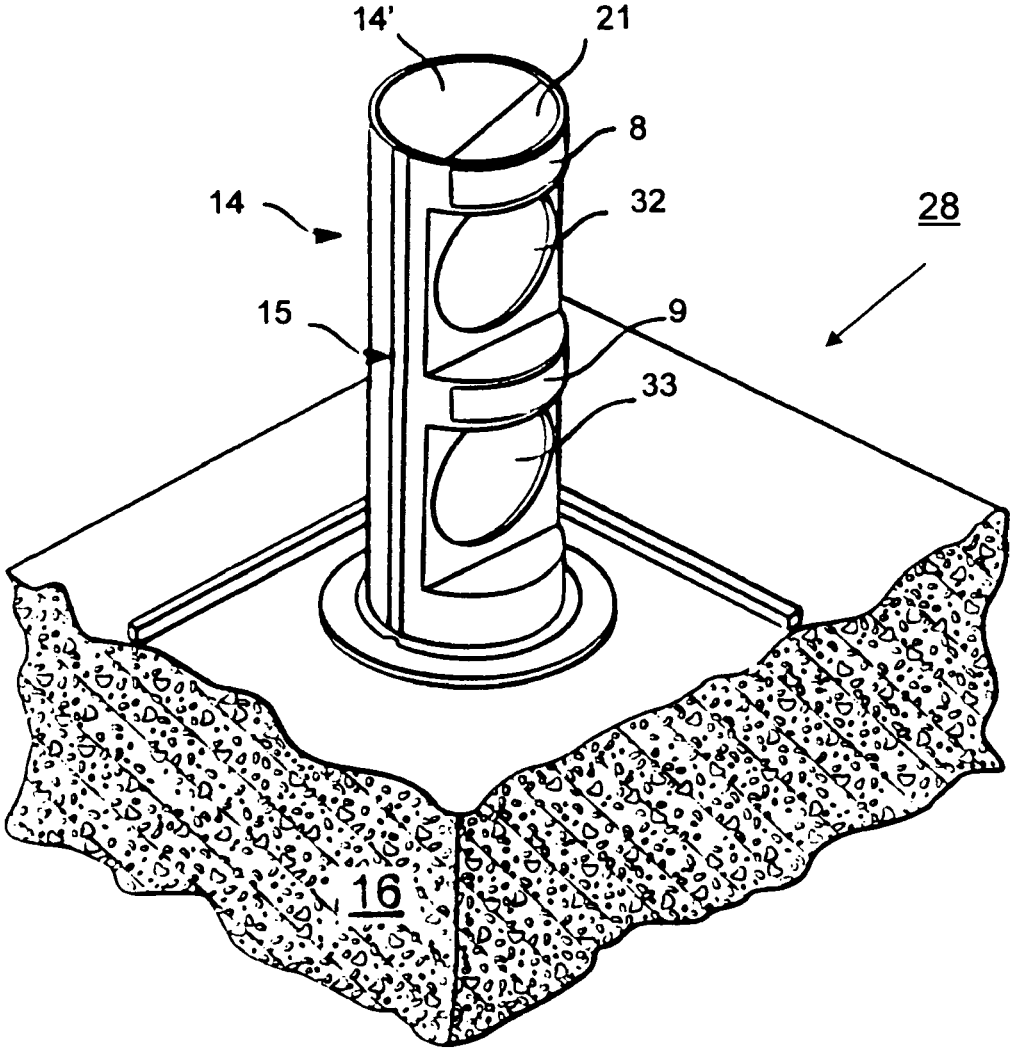
FIG. 2 is a perspective view of the flower identification vase, in vertical position, when is viewed from the side, in the deployed position, over the marble of the memorial.

As shown in FIG. 2 this assembly (10), once installed in the face of the marble slab (16) of the memorial (28), is essentially flush with the marble surface (16) thereof. This assembly (10) is seated within an opening (20) in this slab and essentially permanently bonded thereto with adhesive. In the depiction of the assembly (10) shown in FIG. 1, the flower identification vase (14) is stored within the assembly (10) in the inverted position, specifically, with the body of the flower identification vase (14) facing downward and into the closed end of the storage compartment (12), and, thus, only the closed end or bottom of the base (14") of the vase (14) is visible in FIG. 1 from above. The closed end or bottom of the base (14") of the flower identification vase (14) is provided with a knob (19), which permits removal of the vase (14) from the storage compartment (12) and its installation in an upright position, on the open end (12') of the storage compartment (12).

Figure 3:
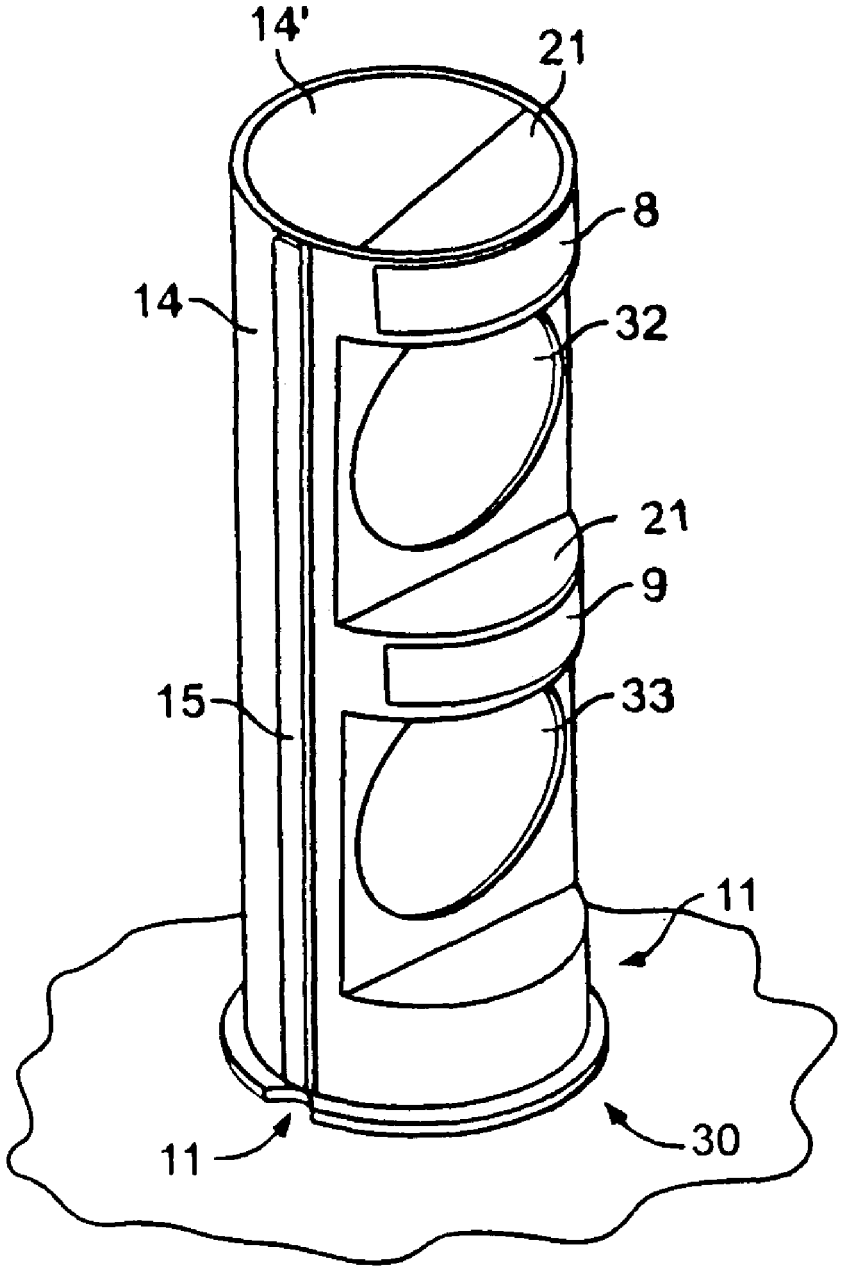
FIG. 3 is a perspective view of the flower identification vase in the deployed position when is viewed from the side and when is out of the ring base of said vase.

FIG. 3 depicts a perspective view of the flower identification vase (14) in an upright position when it is out of the flange (13) of the storage compartment (12). The base (14") of the vase (14), and the open end (12') of the storage compartment (12) include complimentary means (e.g. bayonet-like mechanical means, such as are found on 35 mm cameras with interchangeable lens) (30) for mounting the flower identification vase (14) on the open end (12') of the storage compartment (12) through the two spaces in inverted semicircle (11) present in its exterior base (14") of the vase (14). The means for engagement of the base (14") of the vase (14) to the open end (12') of the storage compartment (12) are discussed in greater detail in references of FIGS. 3, 5, 6 & 7.

FIG. 3A is an enlarged view of FIG. 3.

Figure 4:
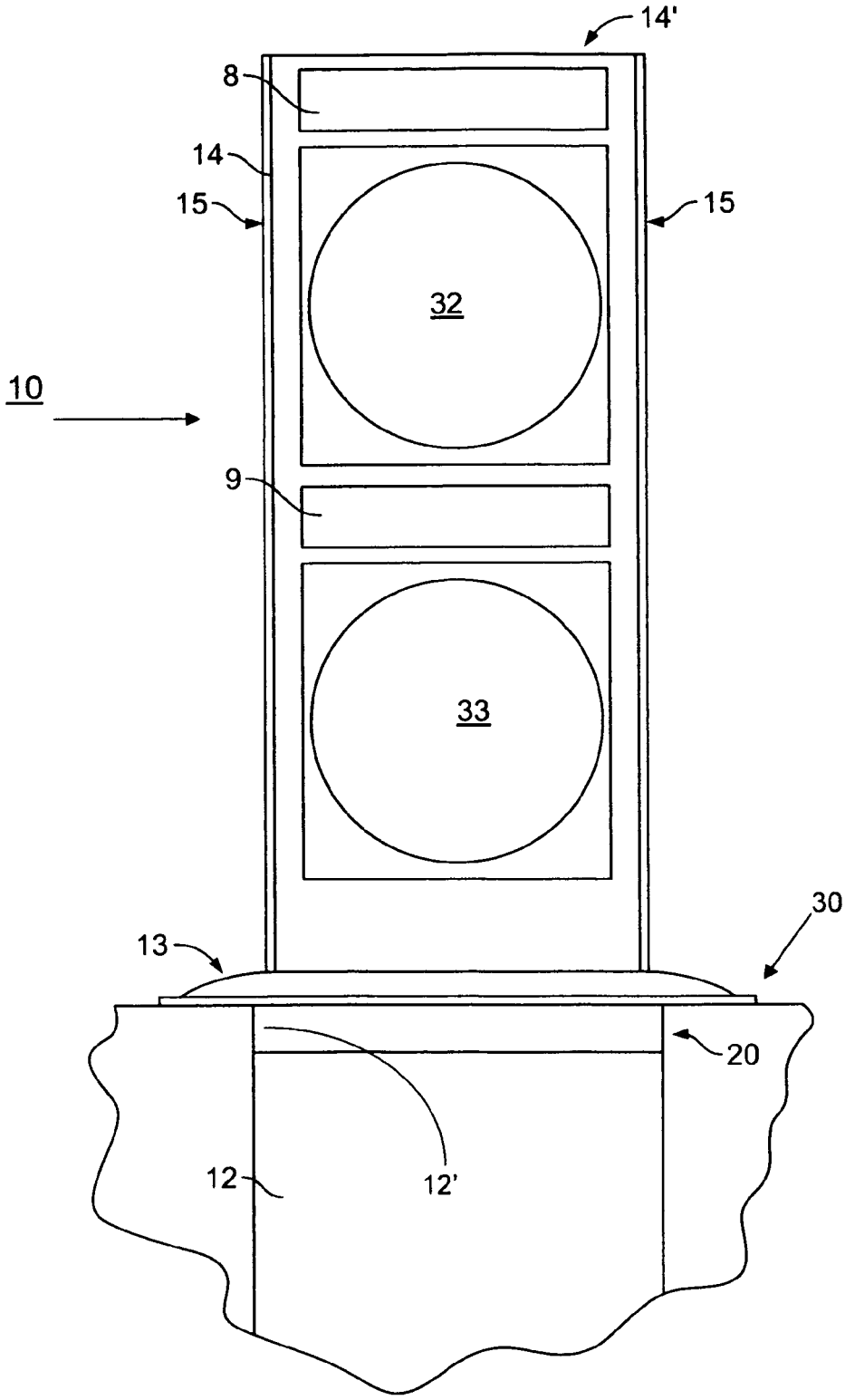
FIG. 4 is a diagrammatic view of the flush mounted assembly of FIG. 1, with the flower identification vase of such assembly being in the deployed position and viewed from the front.

FIG. 4 provides a diagrammatic illustration of the flower identification vase (14) shown in FIG. 2 when viewed from the front. In this depiction, the vase (14) is shown to include two identification engraving tags (8, 9) for personal data of the deceased people and two frames (32, 33) for mounting a photographic reproduction of an individual interred at the grave site. These frames (32, 33) are recessed into the frontal body of the vase (14), as same as the engraving identification tags (8, 9) so as to protect them from damages, as the flower identification vase is withdrawn from and thereafter reinserted into the storage compartment (12) of the assembly (10). The inner wall (20) of the flange (13) is located and fixed into the hole of the memorial marble (16).

Figure 5:
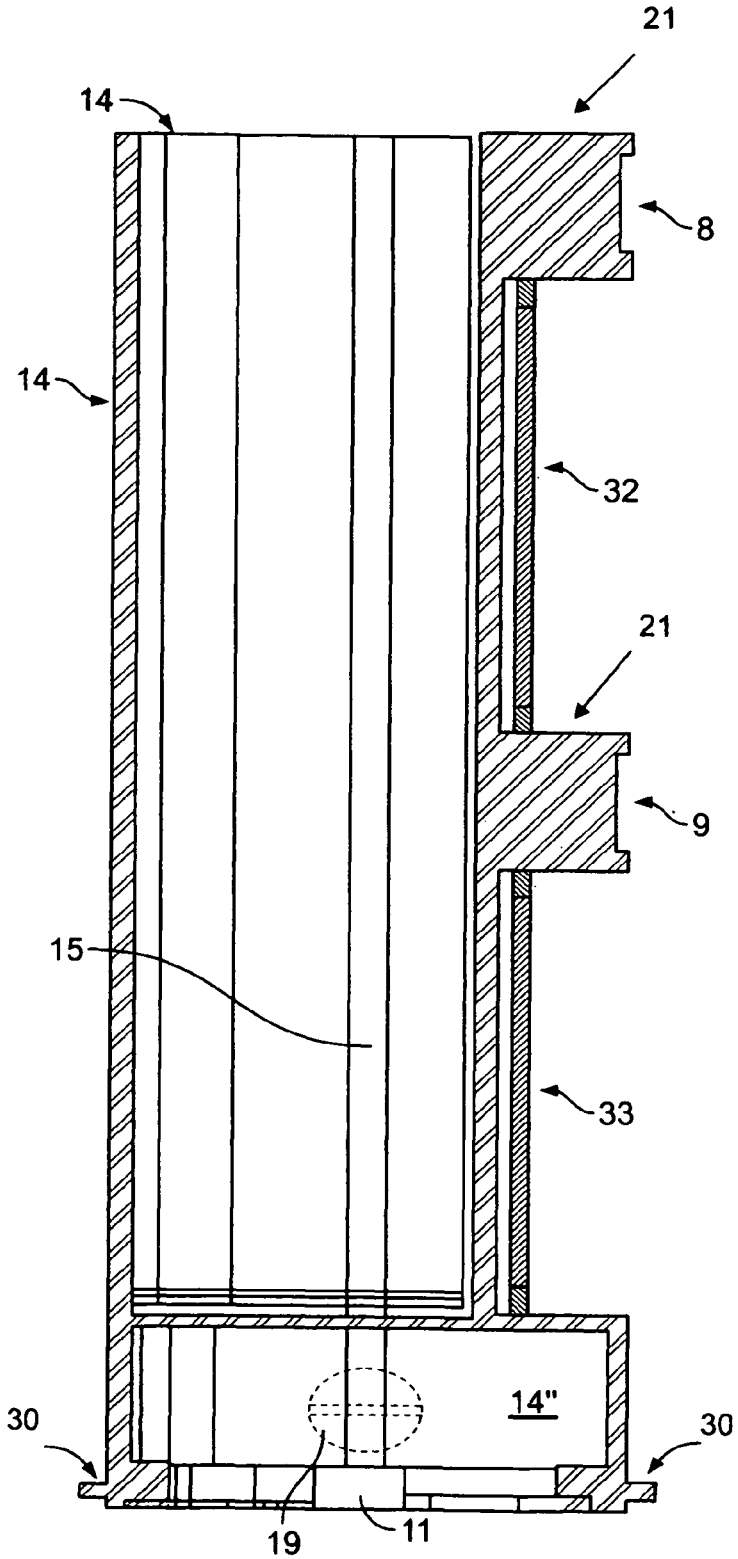
FIG. 5 is a diagrammatic view of the flower identification vase of FIG. 3 when viewed from the side.
Figure 6:
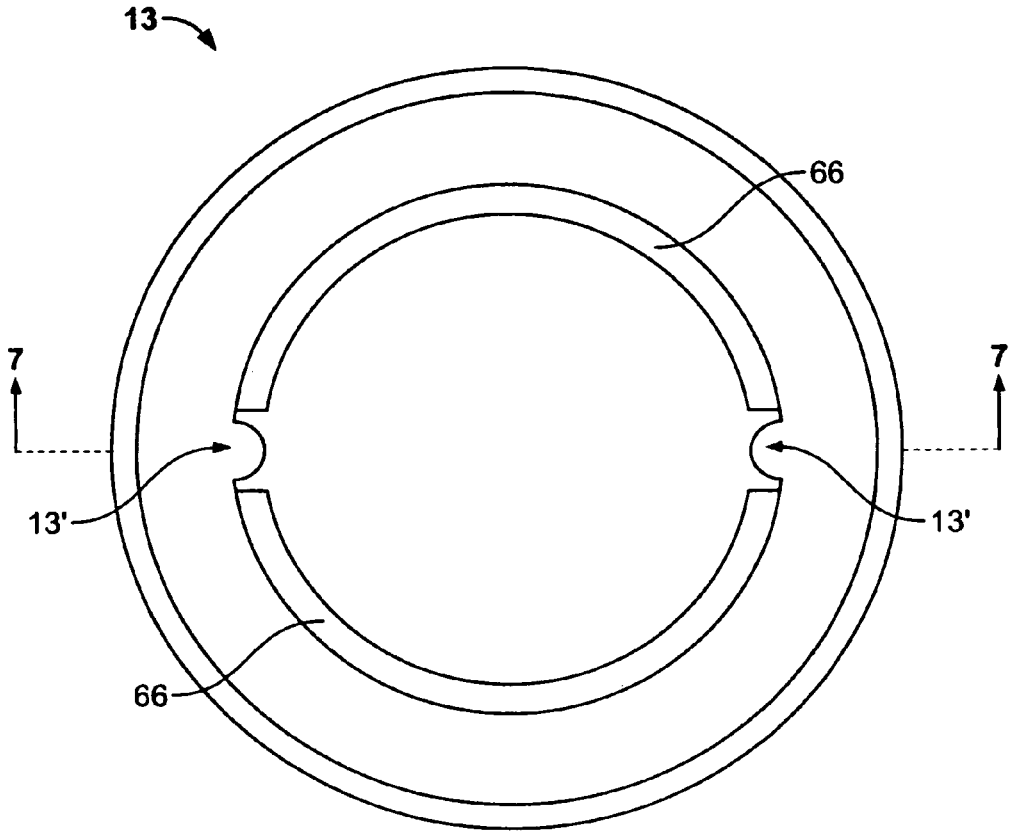
FIG. 6 is a diagrammatic view of the open end of the flange of the storage compartment of the flush mounted assembly of FIG. 1, when viewed from above.
Figure 7:
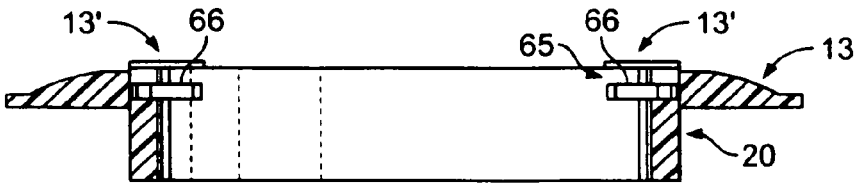
FIG. 7 is a cross-sectional, diagrammatic view of the open end of the flange of the storage compartment of the flush mounted assembly of FIG. 6.

FIG. 5 provides a diagrammatic illustration of the flower identification vase (14) as shown in FIG. 3, when viewed from the side. In this depiction, the recessed frames (32, 33) are shown to occupy the portion of the vase (14), which is visible upon the withdrawal and mounting of the vase (14) on the open end (12') of the storage compartment (12). This recessed frames for photos (32, 33) are protected, as same as the metal tags (8, 9), by a design system of solid bumpers (21) in order to avoid damages in its surface when is operated to enter and exit of the storage compartment. In addition, FIG. 5 illustrates the placement of complimentary means (30) positioned around the base (14") of the flower identification vase (14). These complimentary means (30) are designed to and interlock with a ring-like aperture (13), such as illustrated in FIGS. 6 & 7, which have been formed with open end (12') of the storage-compartment (12). The identification flower vase has two vertical columns (15) in both sides whose purpose is for guiding the placement and withdrawn of said vase of the storage compartment so as to minimize abrasion or damages in its body and to serve an artistic design and guide to indicate the utility lines that it is possible to connect the vase (14) through the two spaces in inverted semicircle (11) present in the exterior part of the base (14") of the vase (14) and into the reverted flanges in semicircle (13') located in the (13), (FIGS. 6 & 7) to support said base (14") of the vase (14) in the eyelash (66) (FIGS. 6 & 7) of the flange (13) in a vertical position (FIG. 4). Once the vase (14) is in the vertical position, the final position is obtained by turning the vase (14) to the right or to the left along the track (65), (FIG. 7) of the flange (13) to lock the vase (14) to the compartment (12) to protect the vase from falls and damages. In order to insert the vase (14) into the storage compartment (12) and to remove it from the flange (13) the same operation is applied in an opposite direction.

In practice, the assembly (10) of this invention can be incorporated, with a cemetery memorial (28) prior to its placement on a grave site or an existing cemetery memorial subsequent to installation by simply drilling a hole in the face of the memorial and mounting the assembly (10) within such hole. In addition to the pictorial information that is included within the frames (32, 33) provided in the vase (14), the bottom of the base (14") include a serial number and a grave site information to identify the vase as belonging to a certain grave site.

What is claimed is:

1. An improved assembly for holding a flower identification vase on a cemetery memorial, said assembly including a housing adapted to be integrated within said memorial and accessible from an exposed face surface of said memorial thereof, said housing comprising an elongate compartment and a flange on an open end of said compartment for mounting said assembly to said exposed face surface of said cemetery memorial, said open end of said compartment comprising an aperture for mechanical attachment and disengagement with complimentary mechanical means associated with said vase, the complimentary mechanical means including a bayonet type mechanism for mounting the compartment with the vase;

said flower identification vase having an exterior shape and dimension consistent with storage and withdrawal of said vase from within said elongate compartment, said exterior shape being generally cylindrical and comprising, a pair of semi cylindrical recesses vertically aligned with each other for mounting a photographic reproduction of a deceased person, a pair of semi cylindrical protrusions formed above each of said recesses, each of said protrusions including a recessed exterior surface for receiving an identification tag, a base formed by a semi cylindrical protrusion below the lower recess, said complimentary mechanical means further comprising projections arranged around said base and configured to interlock with said aperture formed within said compartment to lock the vase to said compartment, said vase being positionable in a first inverted position within said storage compartment and a secured upright, flower receiving position.

2. The assembly of claim 1, wherein said identification flower vase of said assembly includes a pair of vertical columns extending along the entire height of said flower identification vase for guiding the placement and withdrawal of said vase within said storage compartment so as to minimize abrasion and damage to the vase upon its insertion and withdrawal from said compartment.

3. The assembly of claim 1, wherein said vase includes permanent indicia inscribed on the bottom of the base of said vase thereof to identify the grave site to which said vase belongs and a serial number identification.

* * * * *